US009057272B2

(12) United States Patent
Cheah

(10) Patent No.: US 9,057,272 B2
(45) Date of Patent: Jun. 16, 2015

(54) PROTECTIVE POLISHING MASK

(71) Applicant: PRATT & WHITNEY SERVICES PTE LTD., Singapore (SG)

(72) Inventor: Kim Wei Cheah, Singapore (SG)

(73) Assignee: United Technologies Corporation, Hartford, CT (US)

( * ) Notice: Subject to any disclaimer, the term of this patent is extended or adjusted under 35 U.S.C. 154(b) by 220 days.

(21) Appl. No.: 13/656,834

(22) Filed: Oct. 22, 2012

(65) Prior Publication Data

US 2014/0003952 A1 Jan. 2, 2014

(30) Foreign Application Priority Data

Jun. 29, 2012 (SG) ..... 201204863-3

(51) Int. Cl.

| | |
|---|---|
| ***B24B 31/00*** | (2006.01) |
| ***F01D 5/00*** | (2006.01) |
| ***B24B 31/06*** | (2006.01) |
| ***B24B 31/12*** | (2006.01) |

(52) U.S. Cl.

CPC ..... *F01D 5/005* (2013.01); *Y10T 428/31* (2015.01); *B24B 31/06* (2013.01); *B24B 31/12* (2013.01); *F05D 2230/80* (2013.01)

(58) Field of Classification Search

CPC ..... B24C 1/04; B24B 1/00; B24B 31/00; B24B 37/042; A61F 2/16

USPC ..... 451/29, 31, 104, 113, 326–330

See application file for complete search history.

(56) References Cited

U.S. PATENT DOCUMENTS

| | | | | | |
|---|---|---|---|---|---|
| 4,447,992 | A | * | 5/1984 | Bergquist | 451/326 |
| 4,530,861 | A | * | 7/1985 | Sippel et al. | 427/444 |
| 4,691,400 | A | * | 9/1987 | Arneson | 15/3 |
| 4,800,605 | A | * | 1/1989 | Arneson | 15/3 |
| 5,021,101 | A | * | 6/1991 | Loth et al. | 148/518 |
| 5,307,594 | A | * | 5/1994 | Panchison | 451/29 |
| 5,343,657 | A | * | 9/1994 | Ohlin, Jr. | 451/29 |
| 5,375,377 | A | * | 12/1994 | Kenton | 451/22 |
| 5,486,281 | A | * | 1/1996 | Gruver et al. | 205/110 |
| 5,508,206 | A | * | 4/1996 | Glenn et al. | 438/68 |
| 5,551,840 | A | | 9/1996 | Benoit et al. | |
| 5,656,099 | A | * | 8/1997 | Ohmi | 148/280 |
| 5,702,288 | A | * | 12/1997 | Liebke et al. | 451/36 |
| 5,882,500 | A | * | 3/1999 | Abedian et al. | 205/497 |
| 5,998,755 | A | * | 12/1999 | Zajchowski et al. | 219/76.16 |
| 6,107,598 | A | * | 8/2000 | Updegrove et al. | 219/121.7 |

(Continued)

FOREIGN PATENT DOCUMENTS

| | | |
|---|---|---|
| EP | 2289666 | 3/2011 |
| GB | 1128353 | 1/1966 |

(Continued)

OTHER PUBLICATIONS

International Search Report for International Application No. PCT/US2013/044026 dated Aug. 23, 2013.

(Continued)

*Primary Examiner* — George Nguyen

(74) *Attorney, Agent, or Firm* — Carlson, Gaskey & Olds, P.C.

(57) ABSTRACT

An example component polishing method includes polishing a component, and protecting at least a portion of a component during the polishing using a sacrificial mask. Some of the sacrificial mask is removed during the polishing.

11 Claims, 4 Drawing Sheets

(56) References Cited

U.S. PATENT DOCUMENTS

| | | | | |
|---|---|---|---|---|
| 6,116,858 | A * | 9/2000 | Narabayashi | 417/54 |
| 6,183,811 | B1 | 2/2001 | Conner | |
| 6,258,226 | B1 * | 7/2001 | Conner | 204/279 |
| 6,273,676 | B1 * | 8/2001 | Brooks et al. | 415/191 |
| 6,561,872 | B2 | 5/2003 | Farmer et al. | |
| 7,333,218 | B2 * | 2/2008 | Vaidyanathan | 356/614 |
| 8,460,065 | B2 * | 6/2013 | Pei | 451/89 |
| 2005/0048416 | A1 * | 3/2005 | Osawa | 430/322 |
| 2005/0100672 | A1 * | 5/2005 | Stankowski et al. | 427/282 |
| 2005/0227589 | A1 | 10/2005 | Oussaada et al. | |
| 2006/0021579 | A1 * | 2/2006 | Bernaski et al. | 118/720 |
| 2007/0221611 | A1 * | 9/2007 | Chow et al. | 216/13 |
| 2009/0095637 | A1 * | 4/2009 | Toma et al. | 205/640 |
| 2009/0173418 | A1 | 7/2009 | Jayabalan | |
| 2009/0198321 | A1 * | 8/2009 | Sutermeister et al. | 623/1.42 |
| 2009/0235526 | A1 | 9/2009 | Secherling et al. | |
| 2009/0282677 | A1 | 11/2009 | Korn et al. | |
| 2009/0298388 | A1 | 12/2009 | Li et al. | |
| 2012/0329367 | A1 * | 12/2012 | Fitchett et al. | 451/5 |
| 2013/0101737 | A1 * | 4/2013 | Bernaski et al. | 427/255.28 |

FOREIGN PATENT DOCUMENTS

| | | |
|---|---|---|
| JP | 6162541 | 3/1986 |
| JP | 01184282 | 7/1989 |
| JP | 11239958 | 9/1999 |
| KR | 1020030045966 | 6/2003 |

OTHER PUBLICATIONS

Search Report and Written Opinion for Singapore Application No. 201204863-3 mailed on Jul. 14, 2014.

International Preliminary Report on Patentability for PCT Application No. PCT/US2013/044026, mailed Jan. 8, 2014.

* cited by examiner

PROTECTIVE POLISHING MASK

CROSS-REFERENCE TO RELATED APPLICATIONS

This application claims priority to Singapore Patent Application No. 201204863-3, which was filed on 29 Jun. 2012 and is incorporated herein by reference.

BACKGROUND

This disclosure relates generally to polishing a component and, more particularly, to protecting selected areas of a component during polishing.

Many components are polished, including used components and newly-manufactured components. As an example, used gas turbine engine airfoils are often polished to restore their aerodynamic efficiency. Polishing the components enhance their performance within the gas turbine engine. Polishing operations may include hand or machine blending, tumbling, or vibratory polishing.

Material is removed from components during polishing. Removing material from some areas of components is undesirable. For example, excessive removal of material from an airfoil leading edge or an airfoil trailing edge may render the component unsuitable for further use.

SUMMARY

A component polishing method according to an exemplary aspect of the present disclosure includes, among other things, polishing a component, and protecting at least a portion of a component during the polishing using a sacrificial mask. At least some of the sacrificial mask is removed during the polishing.

In a further non-limiting embodiment of the foregoing component polishing method, the sacrificial mask may comprise wax.

In a further non-limiting embodiment of either of the foregoing component polishing methods, the sacrificial mask may be secured directly to the portion of the component.

In a further non-limiting embodiment of any of the foregoing component polishing methods, the sacrificial mask may be removed entirely from the component during the polishing.

In a further non-limiting embodiment of any of the foregoing component polishing methods, some of the sacrificial mask may remain secured to the portion of the component after the polishing.

In a further non-limiting embodiment of any of the foregoing component polishing methods, the component may be an airfoil and the portion may comprise a leading edge or a trailing edge of the airfoil.

In a further non-limiting embodiment of any of the foregoing component polishing methods, the polishing may comprise vibratory polishing the component using a media, and the sacrificial mask may limit contact between the media and the portion of the component.

In a further non-limiting embodiment of any of the foregoing component polishing methods, the method may include dipping the portion of the component in a liquid before the polishing. The liquid may harden to form the sacrificial mask.

In a further non-limiting embodiment of any of the foregoing component polishing methods, the liquid may comprise a paraffin wax.

In a further non-limiting embodiment of any of the foregoing component polishing methods, the method may include removing the portions of the sacrificial mask using media during a vibratory polishing of the component.

A protective mask according to an exemplary aspect of the present disclosure includes, among other things, a sacrificial mask secured directly to a portion of a component. The sacrificial mask protects the portion when polishing the component.

In a further non-limiting embodiment of the foregoing protective mask, the sacrificial mask may comprise a paraffin wax.

In a further non-limiting embodiment of either of the foregoing protective masks, the component may be an airfoil of a turbomachine.

In a further non-limiting embodiment of any of the foregoing protective masks, the portion may comprise a leading-edge or a trailing edge of a turbomachine airfoil.

In a further non-limiting embodiment of any of the foregoing protective masks, some of the sacrificial mask may be configured to remain secured to the component after polishing.

A polished component according to another exemplary aspect of the present disclosure includes, among other things, a component having first surfaces and second surfaces. The first surfaces were directly contacted by media during a polishing, and the second surfaces were protected during the polishing by a sacrificial mask.

In a further non-limiting embodiment of the foregoing polished component, the component may be a turbomachine blade and the second surfaces may comprise a leading edge of the blade.

In a further non-limiting embodiment of either of the foregoing polished components, the second surfaces may be contacted by media during the polishing after removal of the sacrificial mask.

DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

Figure 1:
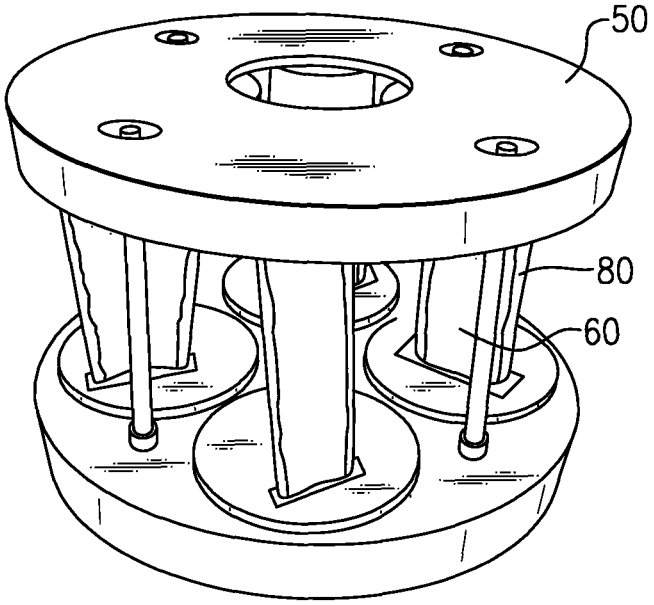
FIG. 1 shows a perspective view of an example component of a turbomachine within a polishing fixture.
Figure 7:
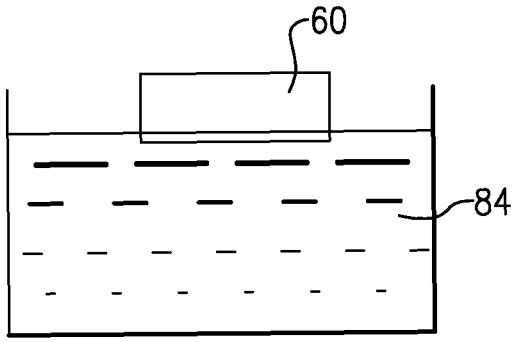
FIG. 7 shows a highly schematic view of the sacrificial mask being applied to the component of FIG. 2.
Figure 2:
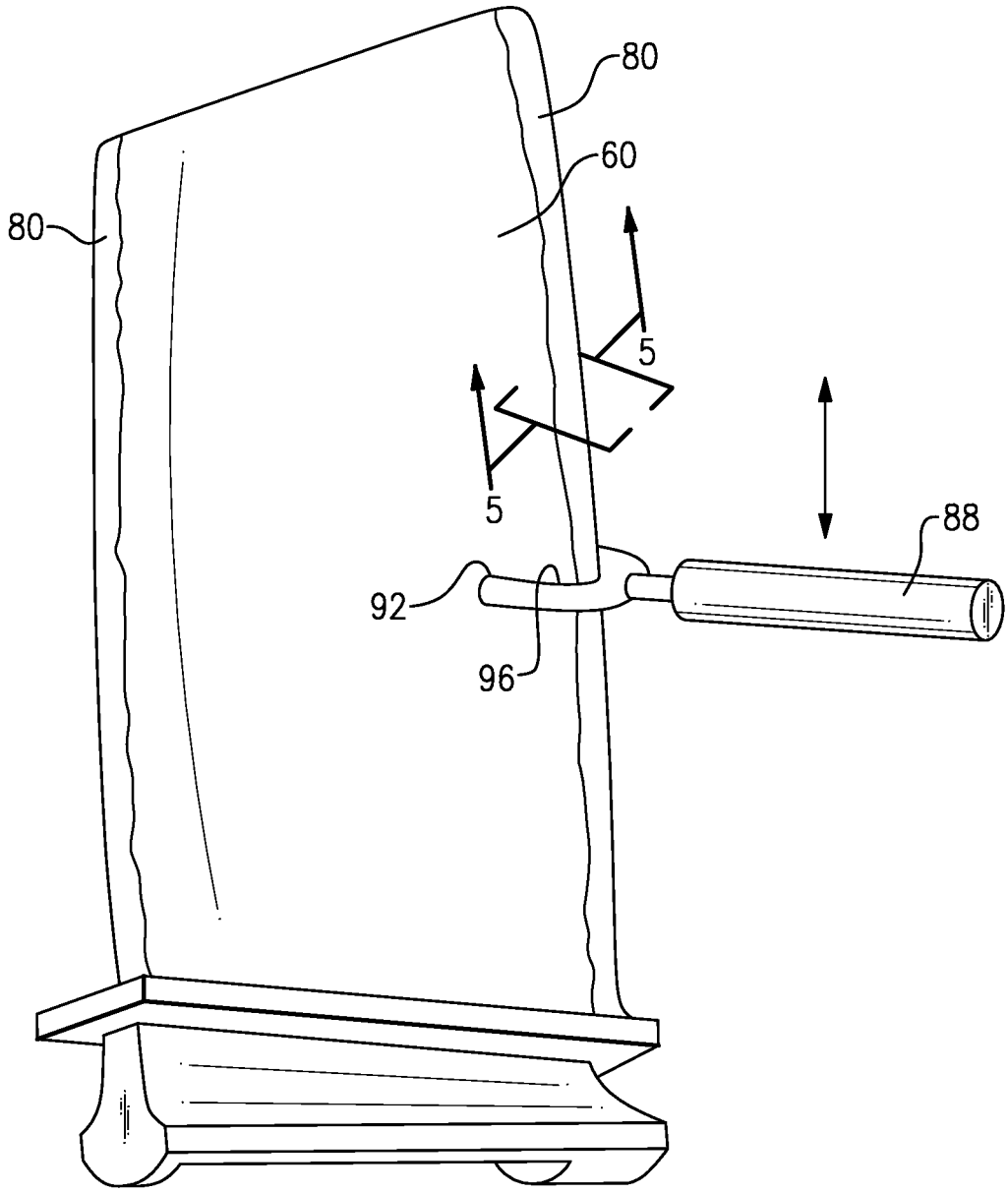
FIG. 2 shows the component of FIG. 1 having a sacrificial mask.
Figure 3:
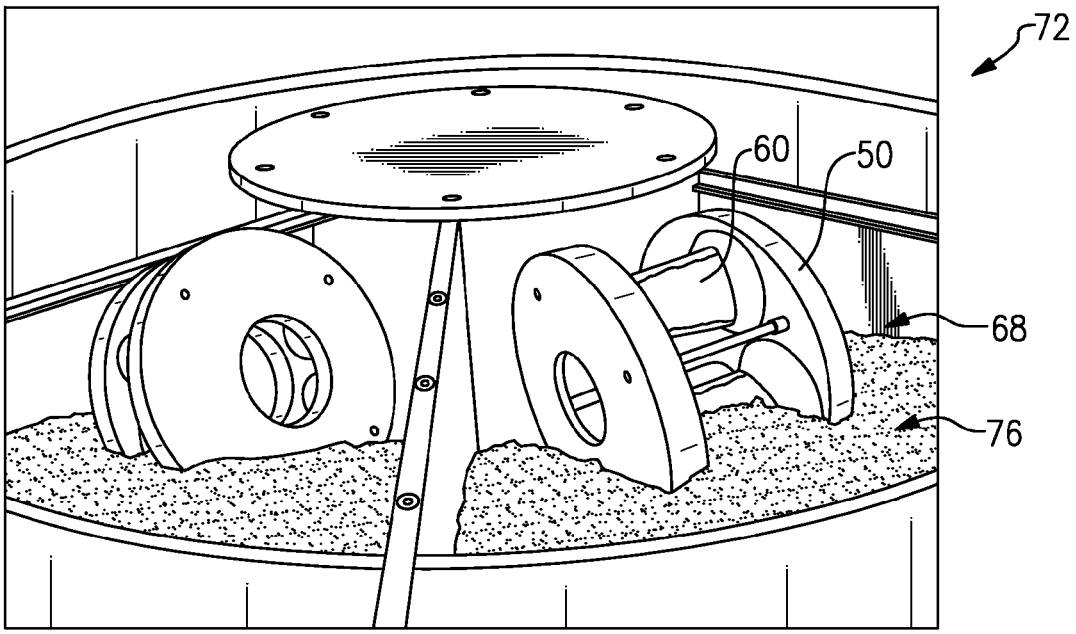
FIG. 3 shows the component and the polishing fixture of FIG. 1 within a vibratory polisher.
Figure 4:
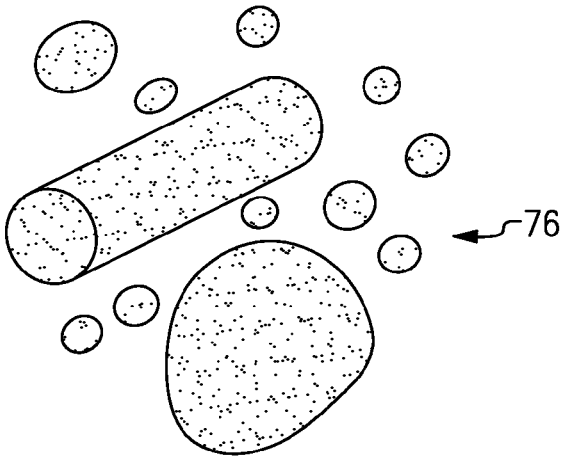
FIG. 4 shows a media suitable for use with the vibratory polishing fixture of FIG. 3.
Figure 5:
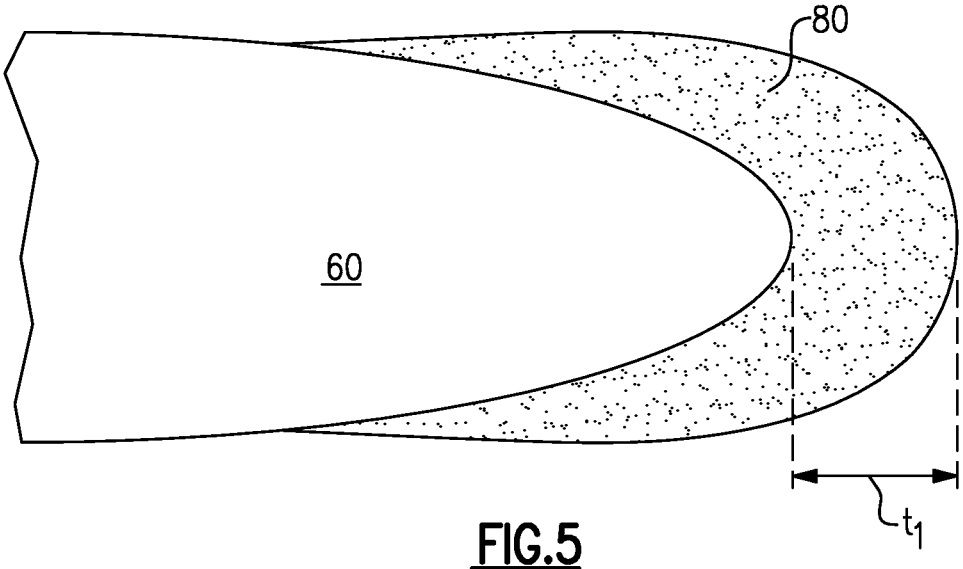
FIG. 5 shows a section view at line 5-5 in FIG. 2 prior to polishing.
Figure 6:
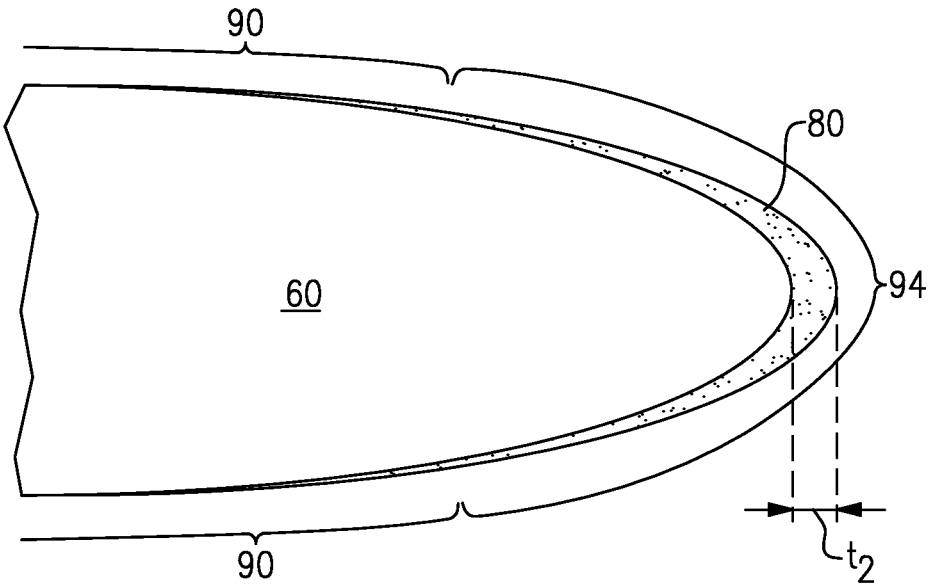
FIG. 6 shows a section view at line 5-5 in FIG. 2 after vibratory polishing some of the component.

Referring to FIGS. 1-7, a fixture 50 holds an example component 60 during a polishing operation. As shown, the fixture 50 may hold other components in addition to the component 60.

In this example, the components 60 are airfoils, such as blades or vanes, from a high-pressure compressor of a gas turbine engine or other type of turbomachine. The fixture 50 may hold other types of components in other examples.

During operation of the gas turbine engine, surfaces of the component 60 may become worn and rough. The component 60 is periodically removed from the gas turbine engine and polished to smooth these surfaces. The component 60 is then reinstalled into the gas turbine engine. A polished component may perform more efficiently than a worn and rough component as is known.

Vibratory polishing is one technique used to polish the components. Other polishing techniques are used in other examples.

During polishing, the fixture 50, together with the component 60, is held within a bin 68 of a vibratory polishing machine 72. The bin 68 is filled with media 76. The vibratory polishing machine 72 is then vibrated rapidly to move the media 76 against surfaces of the component 60. The fixture 50 and the component 60 may be submerged beneath the media 76 during some or all of the polishing. Contact between surfaces of the component 60 and the media 76 polishes those surfaces.

In this example, the media 76 is a ceramic material. The example media 76 includes four distinct sizes. Other examples may exclusively use media having a relatively consistent size. Other examples may use other types of media, and other examples, may be in solid or paste form. That is, the embodiments of this disclosure may be utilized with any type of media.

A sacrificial mask 80 is secured to some portions of the component 60. During the polishing, the sacrificial mask 80 protects those portions by limiting contact between the media 76 and the surfaces of those portions. The sacrificial mask 80 is thus a protective mask. In some examples, the sacrificial mask 80 reduces the time that the media 76 contacts those surfaces during the polishing. In other examples, the sacrificial mask 80 completely prevents the media 76 from contacting those surfaces.

Some of the sacrificial mask 80 may be removed during the polishing due to contact with the media 76, which reduces the thickness of the sacrificial mask 80. The size (e.g., thickness) of the sacrificial mask 80 when initially secured to the component 60 thus helps control whether the sacrificial mask 80 will allow some polishing of those surfaces or no polishing of those surfaces. As shown (FIGS. 5 and 6) a thickness $t_1$ of the sacrificial mask 80 prior to polishing is greater than a thickness $t_2$ of the sacrificial mask 80 after some polishing.

In this example, the sacrificial mask 80 is made thick enough prior to polishing so that portions of the sacrificial mask 80 remain secured to the component 60 after the polishing. In these examples, the portions initially covered by the sacrificial mask 80 are not exposed to any media 76 during polishing because at least some of the sacrificial mask 80 covers those portions throughout polishing. The sacrificial mask 80 remaining after the polishing may be removed using a burn-out process, applying a solvent, etc.

In other examples, the sacrificial mask 80 is made thin enough so that the sacrificial mask 80 is removed entirely from the component 60 during the polishing. In such examples, the media 76 may briefly polish the areas initially covered by the sacrificial mask 80.

After the polishing, the component 60, which is now a polished component, is removed from the fixture 50. The component 60 now includes first surfaces 90 that were directly contacted by the media 76 during the polishing more than second surfaces 94.

The second surface 94 is a leading edge of the component 60 this example. The second surface 94 may also be a trailing edge.

In this example, the sacrificial mask 80 covers the second surfaces 94 throughout the polishing, which prevents the media 76 from contacting those areas. In another example, the media 76 must wears away the sacrificial mask 80 after some of polishing, which allows the media 76 to polish the second surfaces 94 for some amount of time.

The example sacrificial mask 80 is a paraffin wax. Securing the example sacrificial mask 80 to the leading edge of the component 60 involves dipping the leading edge into liquid wax 84. Depending on the required thickness, the component 60 may be dipped and removed multiple times. The liquid wax 84 sticks to the component 60 and hardens to form the sacrificial mask 80.

In some examples, once the liquid wax 84 hardens on the leading edge, a template tool 88 is moved radially along the leading edge of the component 60 to wipe off excess hardened wax and shape the sacrificial mask 80 into a desired thickness. The template tool 88 has corners 92 that contact an area of the component 60 that does not have the sacrificial mask 80. An inner contour 96 of the template tool 88 extends from the corners 92. The inner contour 96 represents the desired thicknesses of the sacrificial mask 80 built up on the leading edge. The template tool 88 removes wax thicker than the desired thicknesses.

In another example, the sacrificial mask 80 is a thermoset material that cures when exposed to ultraviolet light.

Features of the disclosed examples include a sacrificial mask suitable for controlling material removal from selected areas of a component. The sacrificial mask is particularly useful for masking relatively complex areas, such as end-bend airfoil edges and elliptical leading edges of blades. Yet another feature of the disclosed examples is that portions of the sacrificial mask remaining after the polishing may be removed from the component more quickly than hard, non-sacrificial masks.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

I claim:

1. A component polishing method, comprising:

polishing a component; and protecting at least a portion of the component during the polishing using a sacrificial mask, wherein at least some of the sacrificial mask is removed during the polishing, and a thickness of the sacrificial mask prior to polishing is greater than a thickness of the sacrificial mask after some polishing.

2. The component polishing method of claim 1, wherein the sacrificial mask comprises wax.

3. The component polishing method of claim 1, wherein the sacrificial mask is secured directly to the portion of the component.

4. The component polishing method of claim 1, wherein the sacrificial mask is removed entirely from the component during the polishing .

5. The component polishing method of claim 1, wherein some of the sacrificial mask remains secured to the portion of the component after the polishing and some of the sacrificial mask is removed entirely from the component during the polishing to expose a portion of the component that was previously covered by some of the sacrificial mask.

6. The component polishing method of claim 1, wherein the component is an airfoil and the portion comprises a leading edge or a trailing edge of the airfoil.

7. The component polishing method of claim 1, wherein the polishing comprises vibratory polishing the component using a media, and the sacrificial mask limits contact between the media and the portion of the component.

8. The component polishing method of claim 1, including dipping the portion of the component in a liquid before the polishing, the liquid hardening to form the sacrificial mask.

9. The component polishing method of claim 8, wherein the liquid comprises a paraffin wax.

10. The component polishing method of claim 1, including removing some of the sacrificial mask using media during a vibratory polishing of the component.

11. The component polishing method of claim 1, wherein the sacrificial mask is not reusable after the polishing.

* * * * *